US006220450B1

(12) United States Patent
Weeder et al.

(10) Patent No.: US 6,220,450 B1
(45) Date of Patent: Apr. 24, 2001

(54) RUBBER STOPPER SEPARATOR

(75) Inventors: Kristian N. Weeder, Doylestown; Gordon D. Deacon, Telford, both of PA (US)

(73) Assignee: Merck & Co., Inc., Rahway, NJ (US)

( * ) Notice: Subject to any disclaimer, the term of this patent is extended or adjusted under 35 U.S.C. 154(b) by 0 days.

(21) Appl. No.: 09/358,200

(22) Filed: Jul. 21, 1999

Related U.S. Application Data

(60) Provisional application No. 60/095,572, filed on Aug. 6, 1998.

(51) Int. Cl.[7] ..... B07C 5/00; B07C 9/00; B65H 3/28

(52) U.S. Cl. ..... 209/509; 221/221; 221/297; 221/289; 221/258; 221/277; 222/280

(58) Field of Search ..... 198/550.01, 533, 198/454, 624; 222/201, 280, 281

(56) References Cited

U.S. PATENT DOCUMENTS

| | | | | |
|---|---|---|---|---|
| 771,137 | * | 9/1904 | Frerking | 222/281 |
| 1,032,132 | * | 7/1912 | Gormley | 222/281 |
| 4,008,740 | * | 2/1977 | Chermack | 141/100 |
| 4,353,456 | | 10/1982 | Yamamoto . | |
| 4,363,341 | * | 12/1982 | Powell | 141/78 |
| 4,436,226 | * | 3/1984 | Aggen | 222/280 |
| 5,531,312 | | 7/1996 | Dickey . | |

* cited by examiner

*Primary Examiner*—Donald P. Walsh
*Assistant Examiner*—Jonathan R. Miller
(74) *Attorney, Agent, or Firm*—James M. Hunter, Jr.; Elliott Korsen; Mark R. Daniel

(57) ABSTRACT

A device to separate rubber stoppers that have adhered together, typically as a result of sterilization. The device contains a hopper, a pair of rollers and a mechanism to turn the rollers. The rollers are hexagonal-shaped and each face has a scalloped concavity. The adhering stoppers are gravity-fed into the rollers from the hopper, where they are compressed and a shearing force is applied to separate the adherent stoppers. The separated stoppers are then collected for further processing.

4 Claims, 3 Drawing Sheets

RUBBER STOPPER SEPARATOR

This application claims the benefit of U.S. Provisional Application No. 60/095,572, filed Aug. 6, 1998.

FIELD OF THE INVENTION

This invention relates to article separating devices. More particularly, the invention pertains to devices that separate components such as rubber stoppers which have adhered or "twined" together.

BACKGROUND OF THE INVENTION

The rubber stopper sterilization process can lead to adhesion of one stopper to one or more other stoppers, forming a clump. If only two stoppers associate, the interaction is referred to as a "twin". Typically, the twinning phenomenon occurs along the largest flat surface of the components. Stopper twins created as a result of sterilization processes are formed by the treatment of the components with high heats and compression.

Sterile pharmaceuticals are often filled under sterile or aseptic conditions, in an environmentally-controlled aspetic room. Recently, self-contained aseptic filling lines have been developed for filling sterile pharmaceuticals. Self-contained aseptic filling lines, also known as barrier filling lines, eliminate the need for sterile rooms. Barrier filling lines, in which rubber stoppers are used to seal glass or plastic vials, are particularly susceptible to downtime as a result of stopper twins. During the sealing process, stoppers are fed from a sorting bowl onto a rotary wheel which places the stoppers on the vials. When a significantly high number of stopper twins are present in the sorting bowl, single stoppers are unable to be fed onto the rotary wheel for placement on the vials. When this occurs, the filling line must be halted, at which time an operator manually removes the stopper twins from the sorting bowl and replaces them with single, separated stoppers. The filling line is then restarted and filling resumed. Stopper twins are either separated or discarded. Currently, the most effective method for the separation of stopper twins is to separate the twins manually. However, this method does not eliminate the stopper twins and need for frequent shutdowns in order to clear the hopper of twins. Moreover, if the stopper is being used under aseptic conditions, human intervention can lead to greater risk of product contamination. Forceful manual separation methods can increase the amount of particulate matter released during the separation process, which may result in a defective product. Taken together, these problems lead to greater down time, the risk of compromised sterility and increased component waste.

The problem of stopper twinning presents itself in its most pronounced form when stoppers are sterilized under high heats and compression and occurs to varying extents regardless of the type of rubber used in the manufacture of the stoppers or the type of post-manufacture treatments. Stoppers subjected to silicone baths to prevent twinning and provide for a better seal and other pre-sterilization procedures are still prone to twinning. Stopper twinning is therefore seen as a problem that exists wherever sterile stoppers are required. As such, there exists a need for a device that will separate stopper twins without requiring shutdown of an entire filling line.

Devices to address the problem of stopper twinning are not known in the art. Early devices designed by the inventors of the instant invention have all suffered from the inability of the rollers to "grab" the twins and draw them into the rollers for separation. This problem is solved by the unique roller geometry disclosed in the instant invention.

Currently, there is no efficient method for the separation of stopper twins, nor has any solution to the problem been implemented by workers in the fields of either manufacturing or engineering. The only existent devices similar to the instant invention are inapplicable to the problem of stopper twinning and can be used in article sorting and singling only.

The primary object of the instant invention is the separation of stopper twins. Secondary objectives of the invention include the potential for placement of the device on a filling and/or packaging line or its use as a stand-alone component, at the discretion of the operator, and the option to include the invention in-line with high speed and/or sterile filling lines.

SUMMARY OF INVENTION

There is disclosed a device for separating rubber stoppers which have twinned during sterilization processing. In particular, a device which comprises a hopper and a set of uniquely-shaped rollers is disclosed. The invention may be employed as an independent element of a process or as an in-line component of an assembly line. The instant invention is design permits stainless steel construction and it is therefore equally suited for use in either aseptic environments such as barrier filling lines, or in non-sterile conditions.

DETAILED DESCRIPTION OF THE INVENTION

There is disclosed a device for separating rubber stoppers or other components that have adhered together, which comprises:

(a) an article hopper defined by front and back walls which are perpendicular to and abut side walls, the side walls extending below the level of the lowest dimension of the front and back walls;

(b) a pair of rollers positioned below the front and back walls of said hopper and attached to the side walls of said hopper in such a way as to permit free rotation, said rollers having a hexagonal shape along the length of the long axis, each face of the hexagon having a scalloped concavity, and the rollers being situated relative to each other such that when the rollers are at rest, the angle formed by the corner of one roller is orthogonal to the concavity of the second roller, that orientation being maintained during the operation of the rollers regardless of the rotation speed of the rollers, and said rollers being separated from each other by a distance determined to permit the gentle compression of a stopper as it passes between the rollers; and (c) a drive mechanism operably attached to said rollers that effects the rotation of the rollers.

Figure 1:
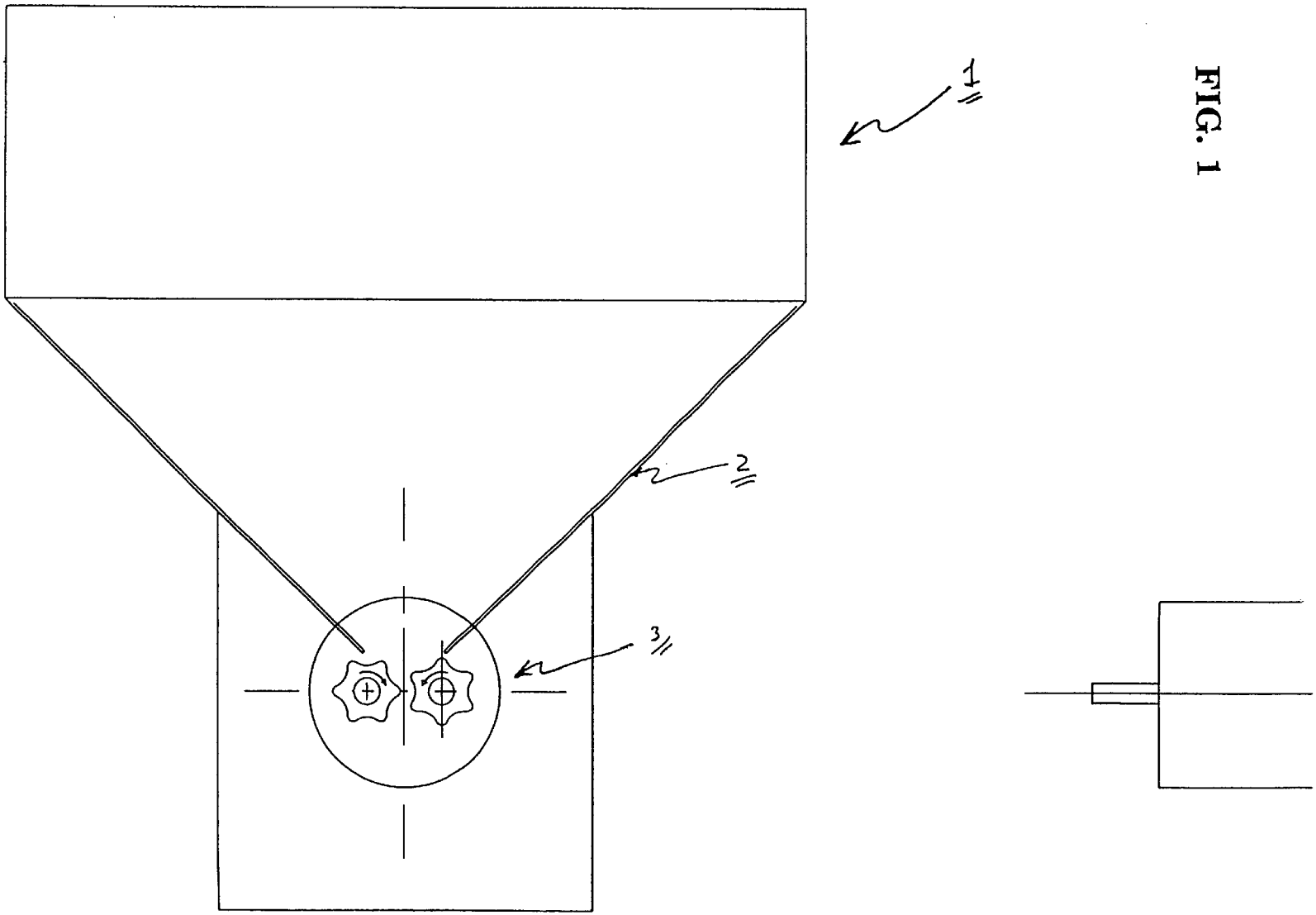
FIG. 1 shows a side view of the hopper into which stoppers are loaded.

Referring to the drawings, FIG. 1 shows a side view of the hopper and rollers. The hopper 1 is constructed of stainless steel, plastic or some other corrosion-resistant material. The side walls are of equal shape and dimension, however they extend below the lowest dimension of the front and back walls. The hopper may be of any shape or size consistent with this requirement. The positional leaves of the invention are seen at 2 . The rollers 3 are seen from the side, and their direction of rotation is indicated by the arrows on the rollers.

Figure 2:
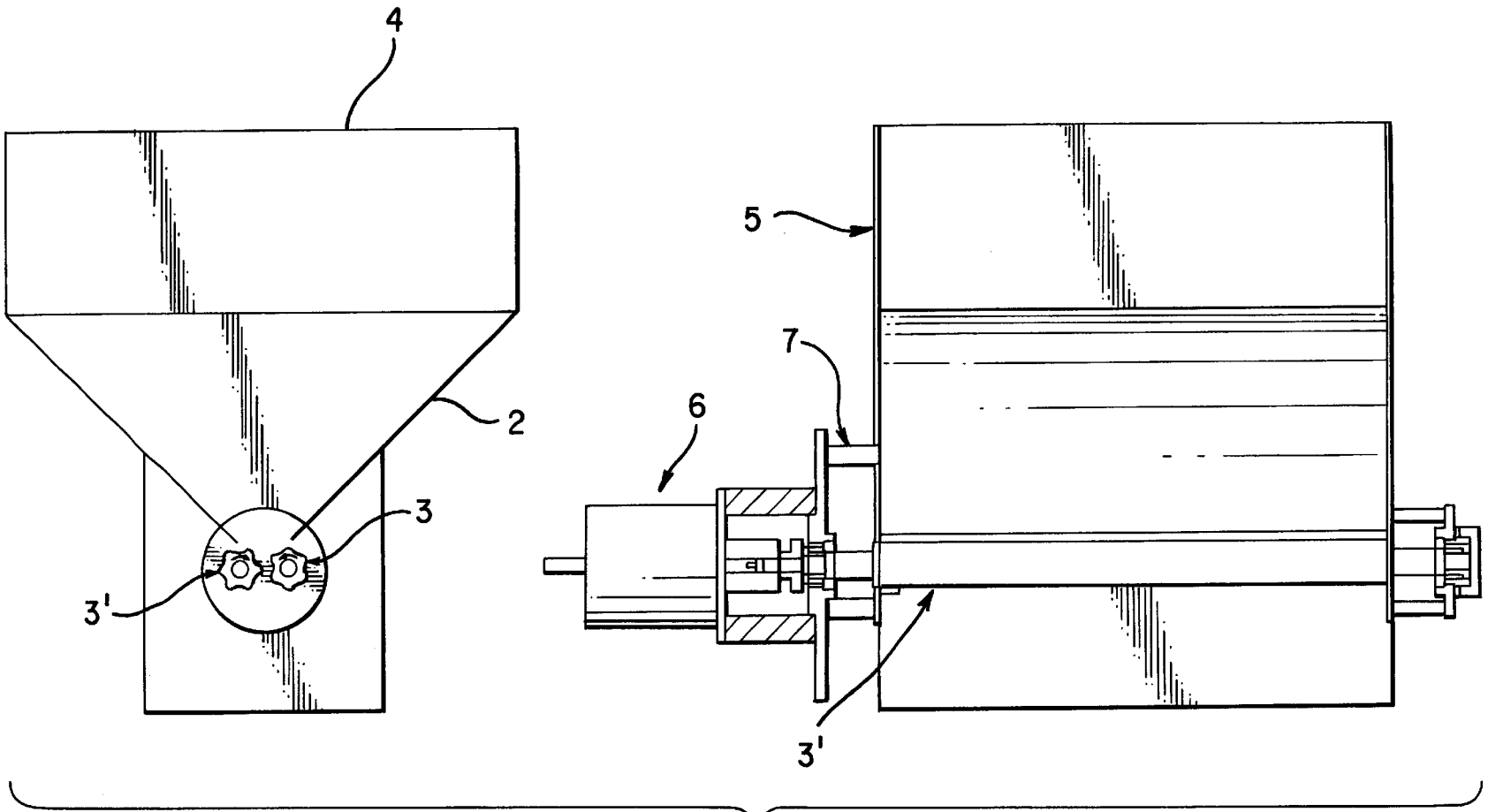
FIG. 2 shows side and front views of the device in its fully assembled form.

FIG. 2 shows side and front views of the invention. The front and back walls 5 are of equal shape and dimension. At the lowest dimension of the hopper, below the front and back walls are placed two leaves 2. These leaves function to define a discharge port through which rubber stoppers to be separated may pass. The leaves are attached by means of a hinge mounted on the section of the side walls that extends below the lowest dimension of the front and back walls. The hinge mounting permits the variable positioning of the leaves in one of two positions: leaves parallel to the front and back walls, creating a wide discharge port for rubber stoppers to pass through, or leaves forming an acute angle with the horizontal axis of the front and back walls, creating a narrow discharge port for stopper passage. Adjustment of the leaf position is accomplished by changing the position of a handle 7 which is mounted on one of the leaves and protrudes beyond the exterior dimension of the side walls of the hopper. The leaves are constructed such that in moving the handle the positions of each leaf may be set independently of one another. The hopper is constructed such that it may be loaded from the top. Access to the interior may also be gained through a hinged panel on the front wall.

As shown in FIG. 2, the hopper and its attached leaves is positioned above two rollers 3 and 3', roller 3' rotating in a clockwise direction and roller 3 rotating in an counterclockwise direction, both of which contact the stoppers and stopper twins to be separated. When the leaves 2 are positioned so as to provide a wide discharge port, the stoppers may fall on either side of the rollers. When the leaves are positioned such that a narrow discharge port is maintained, stoppers and twins located in the hopper are directed onto the rollers. The hopper is constructed such that it may be loaded from the top. Access to the interior may also be gained through a hinged panel on the front wall. The rollers are also seen in the side view and labeled as 3 and **3*i***.

Figure 3:
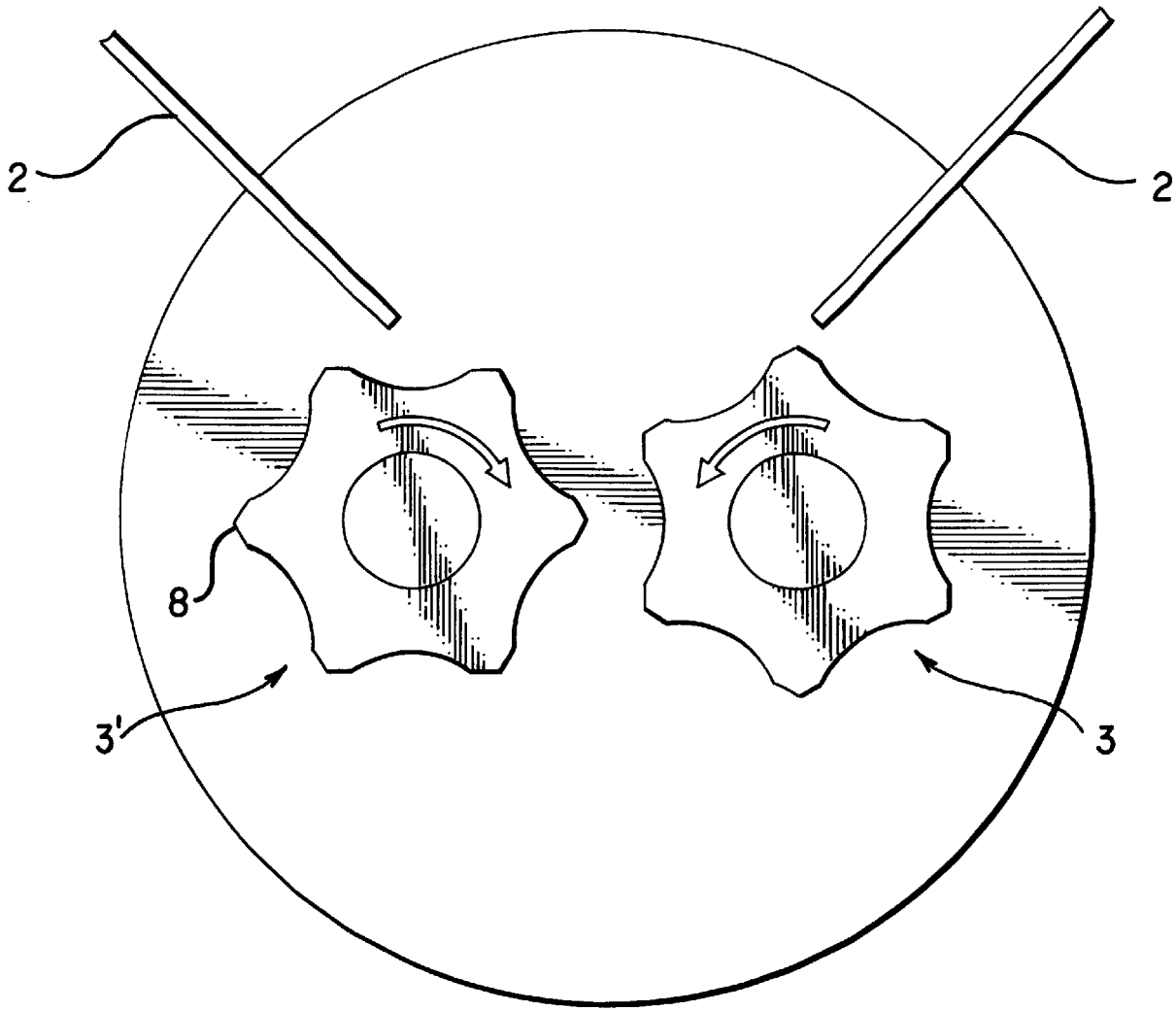
FIG. 3 shows a side view of the rollers used to separate the stopper twins.

A side view of the rollers is shown in FIG. 3. The rollers are constructed of stainless steel and are hexagonal-shaped, with each face machined so as to generate a scalloped concavity. In forming the concavity on each face of the roller, the corner 8 formed by the intersection of each pair of adjacent faces of the roller is maintained. The presence of the corner and the concavity are both required for the invention to fulfill its role of separating stopper twins. This unique geometry of the rollers is the key to the invention. It is essential that the rollers are constantly oriented relative to each other such that the angled corner of one roller is positioned so as to be orthogonal to the scalloped concavity of the second roller, as is shown in FIG. 3.

The method for separating stopper twins is as follows: The hopper is loaded with a volume of rubber stoppers that have been sterilized. The stoppers may also be treated with silicone, typically by immersion in a silicone/water bath. The roller drive mechanism is engaged and the leaves are positioned so as to create a narrow discharge port and direct the stopper twins onto the surface of the rollers. Stopper twins to be separated are gravity-fed onto the rollers from the hopper. Stopper twins contact the rollers and, by virtue of the unique shape of the rollers, are drawn into the space between the rollers. The unique shape and positioning of the rollers generates compressing and shearing forces that effectively separate twinned stoppers.

The separated stoppers fall from the rollers and are collected in a bin placed under the rollers. They are then ready for further processing.

The principles, preferred embodiment and mode of operation of the present invention have been described in the foregoing specification. However, the invention which is intended to be protected is not to be construed as limited to the particular embodiment disclosed. The embodiment is to be construed as illustrative rather than restrictive. It is recognized, however, that departures may be made therefrom within the scope of the invention, and that obvious modifications may occur to a person skilled in the art, and that the metes and bounds of the invention are to determined solely from the appended claims.

What is claimed is:

1. A device for separating rubber stoppers that have adhered together, which comprises:

(a) an article hopper defined by front and back walls which are perpendicular to and abut side walls, the side walls extending below the level of the lowest dimension of the front and back walls;

(b) a pair of rollers positioned below the front and back walls of said hopper and attached to the side walls of said hopper in such a way as to permit free rotation, said rollers having a hexagonal shape along the length of the long axis, each face of the hexagon having a scalloped concavity, and the rollers being situated relative to each other such that when the rollers are at rest, the angle formed by the corner of one roller is orthogonal to the concavity of the second roller, that orientation being maintained during the operation of the rollers regardless of the rotation speed of the rollers, and said rollers being separated from each other by a distance determined to permit the gentle compression of a stopper as it passes between the rollers; and (c) a drive mechanism operably attached to said rollers that effects the rotation of the rollers.

2. The apparatus of claim 1 wherein the drive mechanism is an electric motor capable of being run at variable speeds.

3. The apparatus of claim 1 wherein the apparatus is utilized in a barrier liquid filling line.

4. The apparatus of claim 1 wherein the apparatus is utilized as a stand-alone element in either a sterile or non-sterile environment.

* * * * *